US005083312A

United States Patent [19]

Newton et al.

[11] Patent Number: 5,083,312

[45] Date of Patent: Jan. 21, 1992

[54] PROGRAMMABLE MULTICHANNEL HEARING AID WITH ADAPTIVE FILTER

[75] Inventors: James R. Newton, Burnsville; David A. Preves, Minnetonka, both of Minn.

[73] Assignee: Argosy Electronics, Inc., Eden Prairie, Minn.

[21] Appl. No.: 387,828

[22] Filed: Aug. 1, 1989

[51] Int. Cl.[5] ..... H04R 25/00

[52] U.S. Cl. ..... 381/68.4; 381/68; 381/68.2

[58] Field of Search ..... 381/44, 68, 68.2, 68.4

[56] References Cited

U.S. PATENT DOCUMENTS

| | | | |
|---|---|---|---|
| 4,425,481 | 1/1984 | Mansgold et al. . | |
| 4,471,171 | 9/1984 | Kopke et al. . | |
| 4,484,345 | 11/1984 | Stearns . | |
| 4,508,940 | 4/1985 | Steeger . | |
| 4,517,415 | 5/1985 | Laurence | 381/68.2 |
| 4,548,082 | 10/1985 | Engebretson et al. . | |
| 4,575,586 | 3/1986 | Topholm . | |
| 4,596,900 | 6/1986 | Jackson . | |
| 4,622,440 | 11/1986 | Slavin . | |
| 4,644,103 | 2/1987 | Rosenfield . | |
| 4,674,123 | 6/1987 | Michas . | |
| 4,680,798 | 7/1987 | Neumann . | |
| 4,689,820 | 8/1987 | Kopke et al. . | |
| 4,728,948 | 3/1988 | Fields . | |
| 4,731,850 | 3/1988 | Levitt et al. . | |
| 4,790,018 | 12/1988 | Preves et al. | 381/98 |
| 4,790,019 | 12/1988 | Hueber . | |
| 4,803,732 | 2/1989 | Dillon . | |
| 4,823,795 | 4/1989 | van den Honert . | |

OTHER PUBLICATIONS

*Radio Shack*, 1986 Catalog, No. 393, Index p. 92.

*B. A. Pargh Company, Inc.*

*Siemens Hearing Instruments, Inc.*, "Remote Control".

*3 M Company*, "Announcing the Biggest Breakthrough in Digitally-Controlled Sound Processing to Come Along in Years."

National Semiconductor Databook, pp. 9-212.

*Primary Examiner*—Jin F. Ng

*Assistant Examiner*—Jason Chan

*Attorney, Agent, or Firm*—Haugen and Nikolai

[57] ABSTRACT

A hearing aid is programmable with dual-tone multiple-frequency signals, received through the hearing aid microphone, to adjust operating coefficients of signal conditioning circuitry in the aid. A DTMF receiver filters and detects DTMF tone pairs into digital words provided to a controller for decoding, some of the digital words representing programming instructions and others representing data. In accordance with the instructions, the controller conveys the data to memory operatively associated with a plurality of control ports to the signal conditioning circuitry, with operating coefficients of the conditioning circuitry determined by the contents of the memory.

21 Claims, 4 Drawing Sheets

PROGRAMMABLE MULTICHANNEL HEARING AID WITH ADAPTIVE FILTER

BACKGROUND OF THE INVENTION

This invention is directed to hearing aids, and more particularly to hearing aids that are programmable to provide optimal adjustment of parameters to suit an individual user.

The precise nature of hearing deficiency varies widely among hearing impaired individuals. Accordingly, it is well known that "standard" hearing aids are satisfactory only for a limited number of individuals. In the vast majority of cases, it is desirable to provide a means to adjust a hearing aid, so that its frequency-gain and other characteristics can be adjusted to suit a particular user. Further, it is desirable to provide a hearing aid adjustable to changing acoustical conditions encountered by the user, for example differences in the nature and amplitude of background noise. The acoustic coupling between the hearing aid receiver and the ear drum influences the frequency-gain characteristic of the hearing aid, in which event the actual response of a hearing aid in use may vary from a predicted level based on earlier testing.

For all of these reasons, digital programming has been employed in hearing aids as a means for adjusting operating coefficients or parameters, to more closely tailor the hearing aid response to the needs of the user. For example, U.S. Pat. No. 4,731,850 (Levitt) discloses a hearing aid with an electronically erasable programmable read-only memory (EEPROM) which can be connected to an outside-the-ear controller, through which the EEPROM is loaded with operating coefficients. When the hearing aid is in use, it is disconnected from the controller, and the EEPROM provides the previously loaded coefficients to a random access memory (RAM) through a series parallel converter. The hearing aid microphone supplies signals to a programmable filter through a programmable automatic gain control and a summing amplifier. The programmable filter includes an analog/digital converter, the random access memory, and a digital-analog converter receiving the RAM output. The output of the programmable filter is provided to the hearing aid receiver.

In U.S. Pat. No. 4,622,440 (Slavin), a hearing aid includes an electrically programmable read-only memory (EPROM) for providing instructions to a microprocessor that operates a switched capacitor filter circuit, including digitally adjustable bandpass filters, and an amplifier associated with each bandpass filter. A voice operated switch, receiving its input from two hearing aid microphones through a differential amplifier, provides an input to the filter circuit. The EPROM may be programmed through an input jack connected to the microprocessor. Alternatively, the EPROM may be removed and plugged into a computerized audiometer, then plugged back into the hearing aid following programming.

While these approaches are beneficial in conserving hearing aid space, and permit an increased number of variable functions to be incorporated into a given size of hearing aid, they are subject to disadvantages. The programming work stations are expensive, and typically are suited specifically to the hearing aids of a certain manufacturer. A clinician thus is faced with purchasing such work stations to service different brands of hearing aids. Also, either the aids must be programmed prior to their final assembly within a shell, or a connector must be incorporated into the hearing aid to enable subsequent connection to outside-the-ear programming equipment. Such auxiliary connectors take up valuable surface area and internal volume, particularly in connection with inside-the-ear hearing aids.

Accordingly, it would be desirable to provide a remote or wireless means for programming or otherwise adjusting hearing aids. In this connection, it is known to provide remote control for altering the performance of in-the-canal hearing aids. For example, in a hearing aid produced by Siemens Hearing Instruments, Inc., a remote control device emits ultrasonic signals to provide stepped increases or decreases in the hearing aid volume control.

Programming with dual-tone multiple-frequency (DTMF) signals transmitted over telephone lines is known. For example, U.S. Pat. No. 4,596,900 (Jackson) discloses a control system including a DTMF decoder for providing logic signals in response to predetermined sequences of DTMF signals received over telephone lines. A logic circuit, responsive to the decoder output, provides an input to a controller for turning equipment on or off, checking operating status, or making adjustments. An optional break-in prevent system can be utilized to counter unauthorized attempts to gain entry to the system.

While each of the above systems has been utilized with some success under certain circumstances, none of them satisfactorily addresses the need for an in-the-canal hearing aid conveniently and inexpensively programmed with remotely generated audible signals.

Therefore, it is an object of the present invention to provide a hearing aid programmable conveniently and at low cost, at any stage of its manufacture, including after its assembly into a shell or housing.

Another object is to provide a means for programming a hearing aid without requiring prohibitively expensive programming equipment.

Yet another object of the invention is to utilize the microphone of a hearing aid for adjustably controlling operational parameters or coefficients of the hearing aid, eliminating the need for a special connector for linking the hearing aid with external programming equipment.

SUMMARY OF THE INVENTION

To achieve these and other objects, there is provided a programmable hearing aid, including a sound pressure level transducing means for sensing an audio signal and generating an analog electrical signal corresponding to the sensed audio signal. A signal conditioning means is provided for generating a modified electrical signal as an output responsive to receiving the analog electrical signal. The signal conditioning means includes a plurality of control inputs, each control input being associated with an operating parameter of the signal conditioning means. The hearing aid further includes a receiver means for generating an audio signal corresponding to the modified electrical signal. A control means is operatively associated with the signal conditioning means, for providing one of a plurality of control settings to each of the control inputs. The control means includes a memory means for storing control information including the control settings. A control setting input means is operatively associated with the sound pressure level transducing means and the control means, and provides a predetermined programming signal to the control means responsive to the sensing of a predetermined audio signal by the sound pressure level transducing means. The control means, responsive to receiving the programming signal, selectively alters the control information.

Preferably, the control means includes a microprocessor and the data storage means includes a nonvolatile, programmable digital memory for storing the control settings, in particular a multiple stage electronically erasable programmable read-only memory (EEPROM). Alternatively, multiple stages or banks of programmable read-only memory (PROM) store pluralities of groups of control settings, with the controller including an indexing program for selectively addressing only the group of control settings most recently stored. If desired, a means for overriding the indexing program can reach alternative, previously stored settings to enhance the flexibility of the hearing aid. Yet another alternative would be RAM storage, either capacitively backed to permit battery replacement without memory loss, or configured to permit user re-programming.

The preferred audio programming signal consists of dual-tone multiple-frequency (DTMF) tones. Such tones can be provided to the hearing aid sound pressure level transducer or microphone, with the microphone output in turn provided to a decoder means including a filtering system, signal detecting logic and decoding logic. Typically, initial DTMF signals condition the microprocessor for reprogramming, with subsequent signals accomplishing reprogramming to alter one or more of the parameters at the signal conditioning means inputs. Following reprogramming, a final DTMF signal closes the microprocessor against further reprogramming, to prevent inadvertent reprogramming of the hearing aid by ambient sounds. If desired, the initial DTMF tones also mute the volume control of the hearing aid, so that reprogramming can be accomplished with the hearing aid in the ear, without discomfort to the user.

Another aspect of the present invention is a signal processing circuit for a hearing aid including a sound pressure level transducing means for sensing an audio signal and generating an electrical signal, with signal amplifying means for amplifying the electrical signal to produce an amplified electrical signal corresponding to the audio signal. The circuit includes a plurality of restricted bandwidth filters receiving the amplified electrical signal. Each restricted filter enhances a selected portion of the frequency bandwidth of the amplified electrical signal to generate a selected bandwidth electrical signal. A summing means receives the selected bandwidth signals and generates a combined signal based on a summation of the selected bandwidth signals. An oscillator means provides a clocking signal to each restricted bandwidth filter to determine a control frequency for each of the restricted bandwidth filters, and a clocking control means adjustably controls the clocking signal, thereby to simultaneously adjust all of the control frequencies.

Preferably, the signal processing circuit further includes a plurality of attenuator means, each associated with one of the restricted bandwidth filters and controllably attenuating its associated selected bandwidth signal, thus to provide attenuated selected bandwidth signals to the summing amplifier. A plurality of attenuator control means, one associated with each attenuator means, adjustably controls the amount of attenuation of its associated attenuator means. Consequently, a combination of control frequency and attenuation adjustment for the plurality of selected bandwidth filters is achieved, for a high degree of flexibility in adjusting a hearing aid to meet the needs of the individual user.

The preferred arrangement of restricted bandwidth filters utilizes three, including a low-pass filter, a high-pass filter and an intermediate bandpass filter. The respective control frequencies are cut-off frequencies for the low-pass and high-pass filters, and the center frequency of the bandpass filter.

This signal processing circuit is advantageously employed in connection with the programming features of the present invention. In particular, an oscillator can provide a clocking signal to all of the restricted bandwidth filters, whereby the control frequency of each filter depends upon the clocking frequency. The clocking frequency, in turn, may be adjusted in accordance with a predetermined programming signal generated in response to receiving a predetermined sequence of DTMF signals. Similarly, the attenuator control means can include data storage means for storing one of a plurality of attenuator control settings, with each such setting alterable responsive to receiving a predetermined programming signal, again in response to a predetermined series of DTMF signals.

Programming through the hearing aid microphone can occur at a subassembly stage of manufacturing, or after complete assembly of the hearing aid within a permanent shell. Any programming errors during assembly may be corrected through reprogramming. Adjustments, whether necessitated by component tolerances, changing ambient conditions, or acoustic coupling of the aid and ear drum, may be completed at any time. Clinicians can reprogram the aid on site or over the telephone. A unique command sequence virtually eliminates the possibility of inadvertent programming due to ordinary speaking or other environmental sound patterns. Programming preferably is accomplished with a hand-held DTMF dial tone generator, a low cost alternative to conventional hearing aid programming equipment.

BRIEF DESCRIPTION OF THE DRAWINGS

For a further understanding of the above and other features and advantages, reference is made to the following detailed description of the preferred embodiments, and to the drawings in which.

DESCRIPTION OF THE PREFERRED EMBODIMENTS

Figure 1:
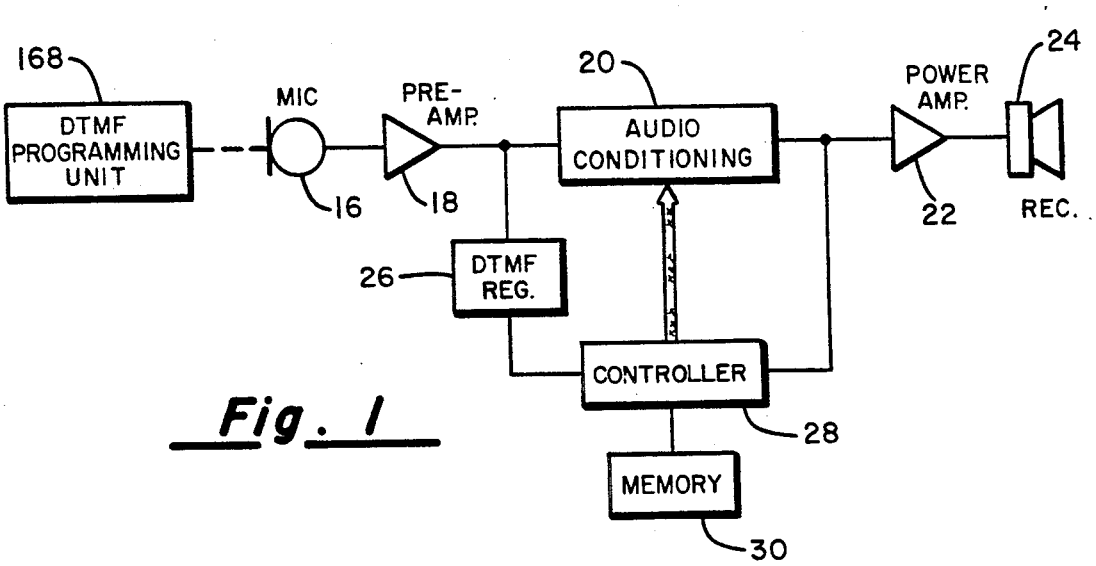
FIG. 1 is a diagrammatic representation of a programmable hearing aid constructed in accordance with the present invention.

Turning now to the drawings, there is shown in FIG. 1, in block diagram form, a hearing aid signal processing circuit used to selectively amplify received audio signals. A microphone 16 receives acoustic signals and converts them into analog electrical signals. A broadband pre-amplifier 18 receives the output of microphone 16 and provides a predetermined amplification of the microphone output, e.g. 40 dB, thus providing an amplified analog voltage signal proportional to the microphone output.

The pre-amplifier output is provided along two separate paths, the first including analog audio conditioning circuitry 20 used during normal operation of the hearing aid. More particularly, circuitry 20 selectively amplifies or otherwise enhances the pre-amplifier output, to generate a modified analog voltage signal dependent upon the input from pre-amplifier 18 and coefficients or parameters at various control inputs to the audio conditioning circuitry. The modified electrical signal is provided to an output stage power amplifier 22, and then to a receiver 24 where the power amplifier output is converted into an acoustic signal sensed by the user of the hearing aid.

The second path beyond pre-amplifier 18 is employed for programming, or setting of operating coefficients, in audio conditioning circuitry 20. On this path, the pre-amplifier output is provided to a dual-tone multiple-frequency (DTMF) receiver 26, which detects pulses of the pre-amplifier output and decodes the analog signal into a digital signal provided to a controller 28, which can be a microprocessor, or static or clocked logic circuitry. A memory 30, operatively associated with controller 28, stores operating programs used by the controller in gaining access to selected control inputs of audio conditioning circuitry 20 and adjusting the associated coefficients. Memory 30 further stores and presents at least one selected set of coefficients to the audio conditioning circuitry to control operation of the hearing aid.

Figure 2:
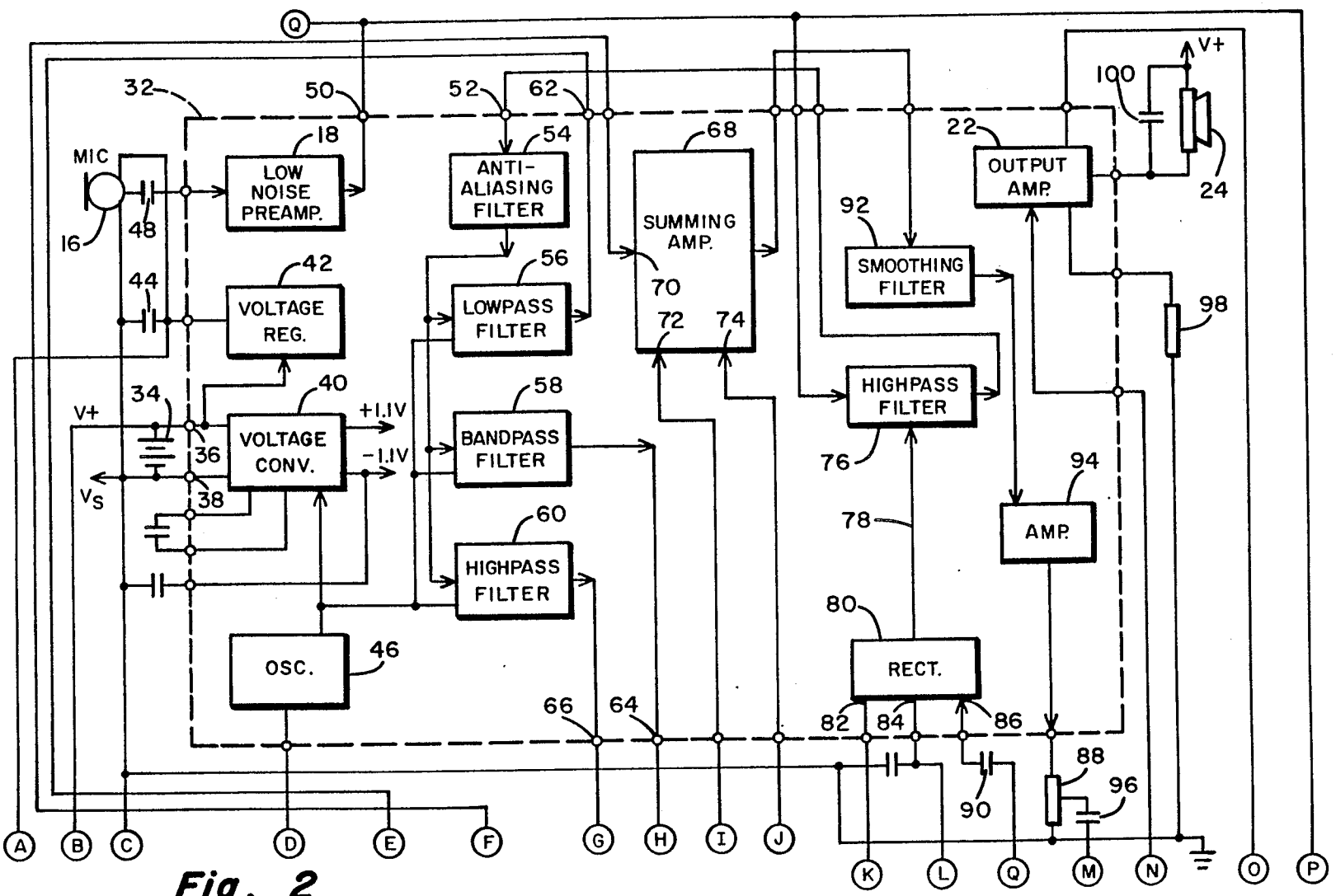
FIG. 2 is a schematic illustration of analog circuitry of the hearing aid.

As seen in FIG. 2, the analog circuitry of the hearing aid, excluding microphone 16 and receiver 24, is configured as a single semiconductor chip represented schematically by a broken line at 32. A plurality of contacts are provided at the chip periphery, to facilitate electrical connection of the chip internal circuitry to external components including microphone 16, receiver 24 and a battery 34. Further contacts are provided for connection of chip 32 with a control semiconductor chip described in connection with FIG. 3.

Two adjacent contact pads 36 and 38 are used in connecting the positive (V+) and ground terminals of battery 34 to a voltage converter 40. The voltage converter has two outputs based on the battery voltage, V+ in the range of from 1 to 1.5 volts, and an inverted output V−, in the range of −1.5 to −1 volts. Voltage converter 40 effectively doubles the internal power supply voltage in providing the negative (referenced to ground) voltage V− equal in absolute magnitude to V+. This provides a bipolar supply at double the battery voltage, to enhance the performance of a low-pass filter, bandpass filter and high-pass filter of which are switched-capacitor filters of the analog circuit.

The battery voltage V+ also is provided to a voltage regulator 42, the output of which (e.g. +0.95 volts) operates through a capacitor 44 to power microphone 16. An oscillator 46 has an output clock frequency range that is a fixed multiple of the frequency range of the low-pass, bandpass and high-pass filters, i.e. 1500 to 4500 hertz. For example, the clock frequency range can be 30 kilohertz to 90 kilohertz for a 20:1 clock:filter frequency ratio. The clock frequency is adjusted and controlled through circuitry on the control chip.

The microphone output is provided through a capacitor 48 to low noise pre-amplifier 18. The output of the pre-amplifier is provided to an adaptive high-pass filter 76, and then to an anti-aliasing filter 54, a second order Butterworth low-pass filter. The output of the anti-aliasing filter is provided to a sample and hold circuit 55 to enhance high frequency performances at low clock rates, and then to a low-pass filter 56, a bandpass filter 58 and a high-pass filter 60, all of which are driven by oscillator 46.

More particularly, oscillator 46 generates a clocking signal provided to filters 56–60 which determines a control frequency for each filter. For example, the control frequency of low-pass filter 56 can be a one kilohertz cut-off frequency. Then, for high-pass filter 60, the control frequency is again a cut-off frequency, at twice the cut-off frequency of filter 56, i.e. two kilohertz. The control frequency of bandpass filter 58 is then a center frequency, midway between upper and lower cut-off frequencies of 1.2 kilohertz and 1.7 kilohertz (i.e. 1,450 hertz). For further information on this approach to configuring restricted bandwidth filters, reference is made to U.S. Pat. No. 4,484,345 (Stearns). While each of filters 56–60 is restricted in terms of the signal bandwidth it enhances, adjacent ranges of the filters overlap one another so that the filters together encompass the full bandwidth of the output of sample and hold circuit 55.

Anti-aliasing filter 54 minimizes or substantially eliminates any artifact arising from the signal sampling frequency of filters 56–60 as determined by oscillator 46. The outputs of filters 56–60 are provided respectively to chip contact pads 62, 64 and 66, to coefficient determining circuitry controlled by the control chip for modification in accordance with hearing aid programming, and then as inputs to a summing amplifier 68 to 70, 72 and 74, respectively.

The summing amplifier output is provided to voltage-controlled adaptive high-pass filter 76. A rectifier 80, which provides a control input 78 to the adaptive high-pass filter, has three inputs, two of which (inputs 82 and 84) are determined by circuitry on the control chip. The output of pre-amplifier 18 is received by rectifier 80 at an input 86 through a capacitor 90. Thus, a signal based on audio input to the hearing aid microphone is converted to a DC voltage level for open-loop control of adaptive high-pass filter 76. The cut-off frequency of adaptive high-pass filter 76 is directly related to the DC voltage at input 84 rectified from the audio signal level on input 86 according to parameters set by variable resistances at inputs 82 and 84. The sensitivity, i.e. the ratio of direct current output to alternating current input, is determined by the resistance between input 82 and ground, controllably determined as discussed below. The minimum output voltage of rectifier 80, with no signal applied at input 86, is controlled by regulating voltage $V_r$ through a resistance to input 84, with the resistance determined on the control chip as explained below in connection with adjusting the "tone" or minimum cut-off frequency of the adaptive high-pass filter.

Filter 76 has a variable 3 dB cut-off frequency governed by the rectifier output. More particularly, the cut-off frequency rises with increases in the control voltage input 78, and falls as the input voltage is reduced. The cut-off frequency divides the amplified voltage signal into a slightly suppressed high frequency portion above the cut-off frequency, and a more substantially suppressed low frequency portion below the cut-off frequency. As a result, the output of high-pass filter 76 is a modified analog electrical signal with its high frequency portion enhanced relative to the signal as a whole. Preferably, preamplifier 18 and rectifier 80 have broadband characteristics, i.e. each responsive to substantially the entire bandwidth of its input signal. For a further explanation of variable cut-off frequency filtering, reference is made to U.S. Pat. No. 4,790,018 (Preves et al), assigned to the assignee of this application.

The output of high-pass filter 76 is provided to smoothing filter 92, which is a second order low-pass filter having a center frequency of 10 kilohertz. The smoothing filter output is provided to buffer amplifier 94, which in turn provides its output through volume control 88 and a capacitor 96, through circuitry of the control chip, then back to the analog chip 32 as an input to output stage power amplifier 22. Amplifier 22 has a fixed gain of 30 dB and a maximum output power that is a function of the impedance of receiver 24 and the value of an emitter bias resistor 98. Further, the maximum peak output power may be reduced by up to 20 dB through a peak-clipping circuit, controlled by a resistance to regulating voltage $V_r$ provided by the control chip at connection 0. The output of amplifier 22 is provided to receiver 24, which is connected in parallel with a capacitor 100 and powered by voltage level V+ from battery 34. Alternatively, for closed loop control, input 86 of the rectifier can be connected to the output of adaptive high-pass filter 76 via smoothing filter 92 and buffer amplifier 94.

Figure 3:
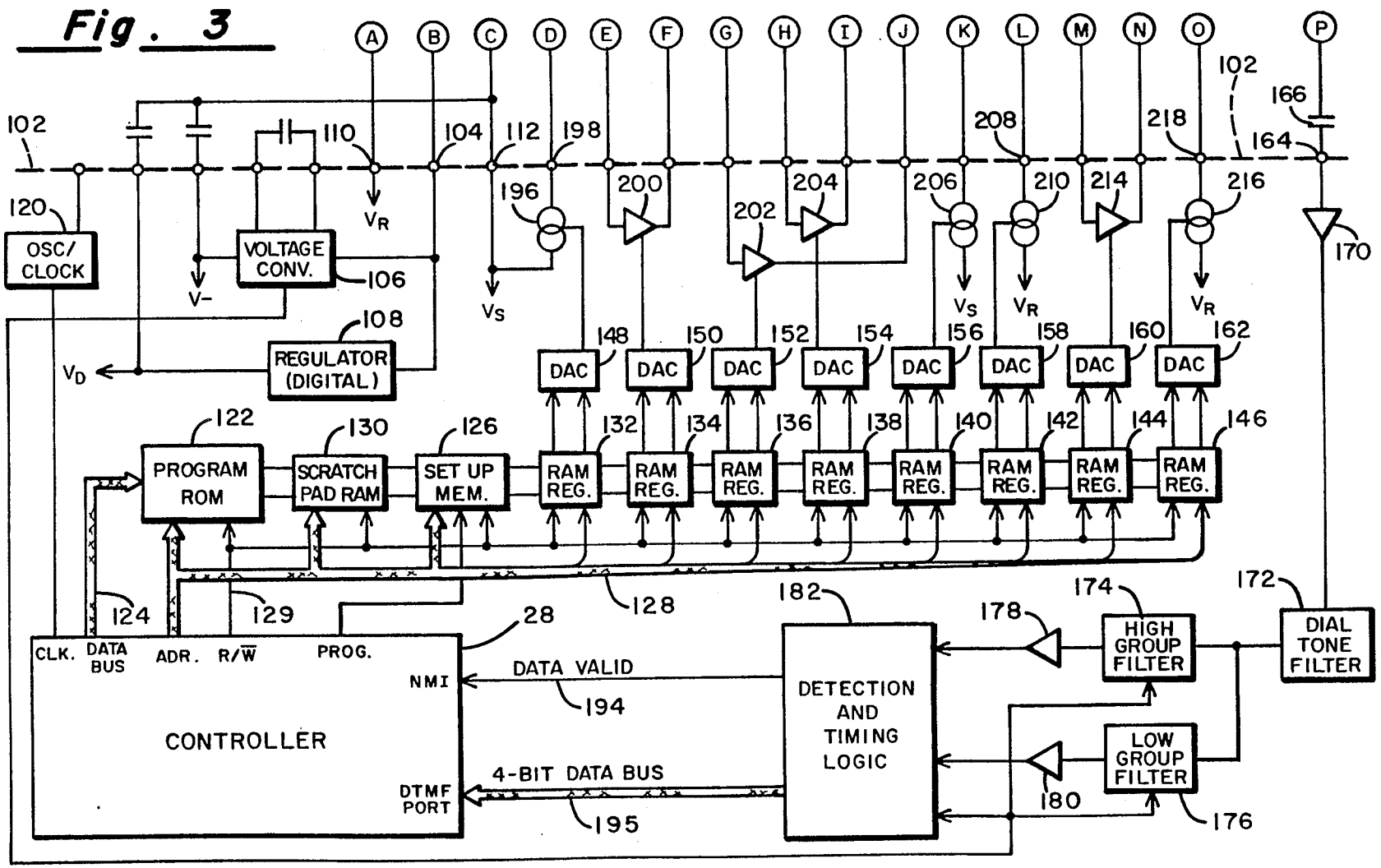
FIG. 3 illustrates schematic circuitry for digitally programming the analog circuitry in FIG. 2.

Some of the contact pads of analog chip 32 provide for connection with circuitry on a control chip 102 shown in FIG. 3. Control chip 102 includes controller 28, preferably a microprocessor used to control conditioning circuitry 20 during normal use of the hearing aid through a plurality of digital-to-analog converters and analog switches interfacing analog chip 32.

Power to drive the digital logic functions carried out on control chip 102 is supplied by battery 34. More particularly, a pin 104 of control chip 102 receives the voltage V+ from the positive terminal of battery 34, for supplying V+ to a voltage converter/inverter 106 and a voltage regulator 108. The output of voltage converter 106 is V−, the inverse of V+, while voltage regulator 108 generates a digital regulating voltage $V_d$. Voltage V− is used to operate switched-capacitor filters used in DTMF receiver 26, while $V_d$ provides a stable reference for a clock oscillator 120 and a pair of zero-crossing detectors of the DTMF receiver. Voltage $V_r$, the output of voltage regulator 42, is received at a pin 110 for use as an input to programmable current sources. Grounding voltage $V_s$ is received at a pin 112 and used in connection with programmable current sinks.

A current-controlled R-C type clock oscillator 120 provides the clocking input to controller 28, voltage converter/inverter 106, and DTMF receiver 26. Controller 28 carries out digital logic functions largely in accordance with permanently masked or hard wired programs in a read-only memory (ROM) 122, operatively associated with the controller through a data bus 124, an address bus 128 and a read/$\overline{\text{write}}$(R/$\overline{\text{W}}$control line 129. The programs in ROM 122 determine the default parameters that control the hearing aid operation in the absence of any programming of the hearing aid to intentionally select alternative parameters.

A volatile scratch pad random access memory (RAM) 130 is associated with controller 28 through address bus 128 and data bus 124, and is used to store intermediate values in computations, memory transfers and similar tasks. ROM 22 is connected to controller 28 through a read/$\overline{\text{write}}$(R/$\overline{\text{W}}$) input, as is scratch pad RAM 130.

A non-volatile but alterable set-up memory 126 is associated with controller 28, ROM 122 and scratch pad memory 130 through the data bus and address bus. Essentially, in a known manner instructions and data are moved over the data bus while the address bus directs such instructions and data to the proper memory location or controller register. Set-up memory 126 stores one or more sets of program instructions loaded from controller 28, for eventual use in determining operating parameters or coefficients for signal conditioning circuitry 20. In a preferred embodiment, set-up memory 126 consists of electrically erasable programmable read-only memory (EEPROM), to allow virtually unlimited altering or re-programming of the program instructions.

Alternatively, set-up memory 126 can consist of programmable read-only memory (PROM), with banks of PROM provided in sufficient number to allow entry of multiple sets of program instructions. The memory banks are indexed such that set-up memory 126 provides only the most recently utilized banks, i.e. the most recently entered set of program instructions. A further option in this event is to provide a paging program in ROM 122 to provide the option of paging back through previously entered sets of program instructions within the set-up memory. Further, paging registers can be provided within set-up memory 126 to allow the most recent page index to be overridden, thereby enabling a previously-entered set-up page to be selected as the default set-up.

Eight four-bit static RAM registers 132–146 are associated with scratch pad RAM 130 and set-up memory 126. Each register is connected to one of eight digital-to-analog converters 148–162. Each register and converter pair is associated with one of eight analog control ports or inputs to signal conditioning circuitry 20. The contents of each RAM register determine the output of the associated digital-to-analog converter, thus to determine the operating coefficient or parameter for the associated control port.

DTMF receiver 26 is connected to contact pad 50 through an audio input pin 164, to receive the preamplifier output through a capacitor 166. Thus, the input to DTMF receiver 26 depends upon the audio signal received by microphone 16. Audio signals used to program the hearing aid are provided by a DTMF tone generator 168 (FIG. 1), which can be of the generally commercially available kind. Tone generator 168 provides a plurality of dual-tone signals, each of which consists of a "high frequency" audible tone and a "low frequency" audible tone, according to standard frequencies as follows:

| Low Frequency Tone | High Frequency Tone |
|---|---|
| 697 Hz | 1209 Hz |
| 770 Hz | 1336 Hz |
| 852 Hz | 1477 Hz |
| 941 Hz | 1633 Hz |

DTMF receiver 26 receives the output of preamplifier 18 regardless of whether microphone 16 is receiving DTMF tones or other audible signals. However, controller 28 becomes conditioned for programming functions only if receiver 26 detects individual DTMF tone pairs, and a predetermined sequence of valid tone pairs is decoded a described below, thus to prevent unintentional or accidental re-programming of the hearing aid with ambient sounds. To this end, DTMF receiver 26 includes an AGC amplifier 170 for amplifying the signal received at audio input pin 164 and providing its output to a pair of six-pole elliptical bandpass filters, namely a high-group filter 174 and a low-group filter 176. Low-group filter 176 places notches at 350 hertz and 440 hertz to attenuate the telephone dial tone signal. Filters 174 and 176 are switched-capacitor filters, and split an incoming signal based on DTMF tones into high-band and low-band signal frequency components. If the signal received at pin 164 has been generated as a result of microphone 16 receiving a standard DTMF tone, the outputs of filters 174 and 176 are the respective low-band and high-band tones of the particular DTMF or composite tone.

Comparator amplifiers 178 and 180 receive the output of filters 174 and 176, respectively. Each of amplifiers 178 and 180 functions as a zero crossing detector, converting the sinusoidal output of its associated bandpass filter into a logic compatible waveform of the equivalent frequency.

Detection and period measurement logic, indicated at 182, receives the respective pulse trains from amplifiers 178 and 180, converts them to period measurements corresponding to detected frequencies, and provides the period measurements to controller 28 for decoding. Preferably, eight-bit timer registers are provided in controller 28 and up-dated at a clock rate of 175 kilohertz, to differentiate among the high-group and low-group DTMF frequencies. Thus, controller 128 determines if each of the zero crossing amplifier output waveforms represents one of the permitted frequencies, and if so, whether the two frequencies when combined constitute a valid DTMF tone, and finally, whether the zero crossing waveforms were presented to detection and measurement logic 182 for a sufficient time to distinguish a true DTMF tone from an accidental replication of the frequency pair due to speech or other noise. If all of these events are confirmed, an input 194 enables controller 28 to receive data over a four-bit data bus 195. The data is comprised of four-bit digital words corresponding to identified DTMF tones.

The four-bit digital words are used by controller 28 in altering the contents of set-up memory 126, thus altering the programming instructions the set-up memory provides to random access memory registers 132–146 under normal operation of the hearing aid. Each RAM register and digital-to-analog converter pair is associated with an analog input or port to signal conditioning circuitry 20, thus to form the operative interface between analog chip 32 and control chip 102.

The control ports are of three general types: current sinks, current sources and attenuators. Each port is adjustable in accordance with the output of its associated one of digital-to-analog converters 148–162, i.e. adjustable according to the instructions in its associated RAM register.

Individually, the control inputs include a current sink 196 connected to oscillator 46 through a pin 198. Current sink 196 is biased by grounding voltage $V_s$, and controlled by the output of digital-to-analog converter 148 as determined by the program instructions in RAM 132. The clocking frequency output of oscillator 46 is provided to filters 56, 58 and 60, and thus current sink 196 adjustably determines the control frequencies of these three filters, simultaneously. For example, instructions in RAM 132 corresponding to the previously mentioned control frequencies for filters 56–60 might be reprogrammed to increase the cut-off frequency of low-pass filter 56 from one kilohertz to 1,050 hertz, whereupon the cut-off frequency of high-pass filter 60 and center frequency of bandpass filter 58 also would increase by five percent.

An operational transconductance amplifier 200 is connected between the output of low-pass filter 56 and the input to summing amplifier 70, thus to control the gain (i.e. attenuation) between the low-pass filter and summing amplifier stages. The gain varies with the output of digital-to-analog converter 150, as determined by the contents of RAM 134.

In similar fashion, operational transconductance amplifiers 202 and 204 are connected between summing amplifier 70 and the outputs of bandpass filter 58 and high-pass filter 60, respectively, for controlling the gain between these filters and the summing stage. Amplifiers are controlled through RAM registers 136 and 138, respectively, and more directly by converters 152 and 154.

A current sink 206 is connected to rectifier 80 through a pin 208 and thus is biased by grounding voltage $V_s$. Current sink 206, controlled by digital-to-analog converter 156 and RAM 140, determines the sensitivity of the adaptive filter, which concerns the DC voltage level supplied at input 82 to rectifier 80.

A current source 210 is connected to rectifier 80, biased by voltage regulator output $V_r$ and controlled by digital-to-analog converter 158 and RAM 142. Current source 210 is varied to adjust the tone of the adaptive filtering in the hearing aid, i.e. the frequency of the 3 dB cutoff in response to a given sound pressure level input to microphone 16. For a further explanation of this feature, reference is made to the aforementioned U.S. Pat. No. 4,790,018.

An operational transconductance amplifier 214 is connected between volume control 88 and a gain control input to output stage amplifier 22. Amplifier 214, controlled by digital-to-analog converter 160 and RAM 144, limits the output stage amplifier gain in a manner to control maximum system gain, and if desired, can temporarily mute the hearing aid. Consequently the hearing aid may be reprogrammed while in the ear, with no annoyance or discomfort to the hearing aid user.

The final control port or input is a current source 216 connected to output stage amplifier 22, through a pad 218, biased by regulator analog output voltage (output of regulator 42) and controlled by digital-to-analog converter 162 and RAM register 146. Current source 216 provides a clipping function to limit the maximum output of the output stage amplifier and thereby limits the maximum sound pressure level output of receiver 24.

In the preferred embodiment, the following values have been found satisfactory for various components:

| COMPONENT | VALUE |
|---|---|
| Capacitor 44 | 1 microfarad |
| Capacitor 48 | 0.47 microfarads |
| Capacitor 90 | .047 microfarads |
| Capacitor 96 | 0.47 microfarads |
| Capacitor 100 | 0.1 microfarad |
| Capacitor 166 | .047 microfarads |

Programming with DTMF tones includes conditioning controller 28 to receive binary instructions from DTMF receiver 26, providing the instructions to alter the contents of the memory associated with the controller, and terminating programming by reconditioning the controller so that is no longer accepts instructions. In physical terms, DTMF tone generator 168 is held near the hearing aid microphone, or alternatively the DTMF "touch tones" from the generator or other source are conveyed to a remote hearing aid, for example over telephone lines.

DTMF programming preferably is based on a series of DTMF tones in accordance with a programming protocol, for example pursuant to the following table:

| | |
|---|---|
| #*# | Clear for programming |
| XYYY | Programming data |
| # | Command separator |
| S** | Transfer X to RAM (PROM only) |
| *** | Terminate programming |
| *0* | Terminate programming and store settings |

Controller 28 normally is not conditioned to accept instructions, and becomes conditioned only when receiving the series of three binary words representing programming clearance tones #*#. Consequently, the potential for accidental conditioning of controller 28 for "programming" by ambient noise is virtually eliminated.

The character X in the data instruction is a numeral from 0–7 identifying a particular one of RAM registers 132–146. The remaining symbols (YYY) numerically identify the program instruction to be loaded into the associated RAM, or alternatively the instruction loaded into set-up memory for later loading into the RAM. The symbol # simply ensures proper separation between succeeding commands.

The instruction * terminates the programming and takes controller 28 out of the programming condition or mode. The instruction *0* accomplishes the same, and further transfers the current contents of the RAM registers into set-up memory 126**.

The instruction S is used only when set-up memory consists of PROM banks, whereby more than one set of instructions can be permanently stored. In this instruction, S is a single digit representing an entire set of instructions, i.e. determining the contents of all eight RAM registers. As an example, with three sets of instructions stored in PROM and consecutively numbered 1–3, most recent set 3** would be provided to the RAM registers in the absence of contrary instructions. The instruction series *#* 2  conditions the controller for programming, removes the third set from the RAM registers and replaces it with set 2**.

A complete programming series for the hearing aid could proceed as follows, beginning with the following string of instructions to initially set all eight RAM registers:

***#* 0128 #1056 #2250 #3150 #4228 #5000 #6050 #7190 *****

At this point, the settings are not permanently stored, but rather loaded into the RAM registers and backed by the hearing aid battery. During this initial loading and in subsequent loading of instructions, scratch pad RAM 130 provides intermediate storage of the instructions for error check and other housekeeping functions necessarily performed in cooperation with controller 28.

Assuming that some further testing indicates that it would be desirable to adjust the center frequency of filters 56, 58 and 60, and further adjust the gain of bandpass filter 58, the following instruction could be entered:

*#* 0188 #3200 ***

At this stage, the client is requested to wear the hearing aid for a trial period, perhaps a few days, to determine whether the setting is appropriate. The client returns and mentions conditions which, to the clinician, indicate a need to adjust the adaptive filter sensitivity, and clipping, i.e. RAM registers 142 and 146, leading to the following instruction series:

*#* 5100 #7180 ***

After another trial period, the client reports totally satisfactory operation, leading to final programming necessary to permanently load the settings into set-up memory:

*#* *0*

Further in accordance with the present invention, FIG. shows a modification employing an electronically erasable programmable read-only memory (EEPROM) configured into four separate pages at 220, 222, 224 and 226. Each of the pages contains one complete set-up or group of program instructions which can be selectably loaded into RAM registers 132–146. The current or most recently selected one of the set-ups is retained in an EEPROM register 227, and upon power-up is automatically located into the RAM registers, here represented as a single block 230. An alternative set-up, i.e. the contents of an alternative one of pages 220–226, can be selected by a paging switch 232. Switch 232 preferably is a momentary contact push-button switch mounted on the face plate of the hearing aid, through which the pages may be selected in a repeating sequence indicated at 234, 236, 238, 240, back to 234, etc., thus to selectively enable one of the pages. Each of pages 220–226 is loaded with a set-up via a controller and ROM (not shown) and scratch pad RAM 128 in the manner previously described. Plural pages provide an added option for the hearing aid user, namely selecting from among settings programmed to suit various environments based on the amount and nature of background noise.

Figure 5:
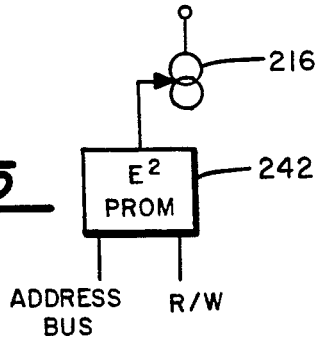
FIG. 5 illlustrates alternative memory employed at the interface between the analog and digital circuitry.
Figure 4:
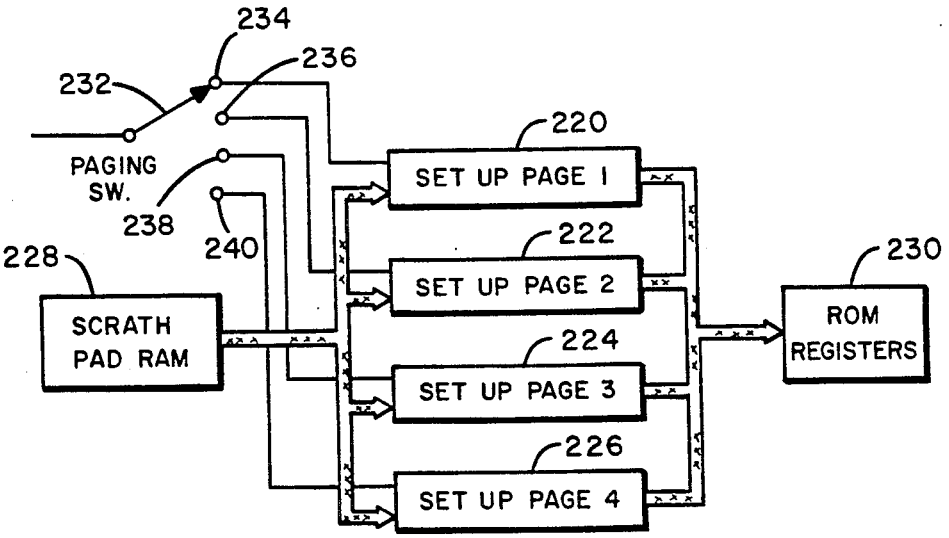
FIG. 4 illustrates alternative embodiment hearing aid circuitry with, a plurality of individually selectable programmed settings.

FIG. 5 discloses another modification of the invention in which each RAM register and digital-to-analog converter pair is replaced with an electronically erasable programmable read-only memory. As one example, an EEPROM 242 is provided to control current source 216 in lieu of RAM register 146 and digital-to-analog converter 162. This approach calls for greater sophistication in semiconductor chip manufacturing. However, it reduces the amount of circuitry required, for a smaller chip size and reduced current requirement, permitting use of a smaller battery. Consequently, the programming circuitry and battery may be used with smaller hearing aids, to meet the needs of a wider range of clients.

Figure 6:
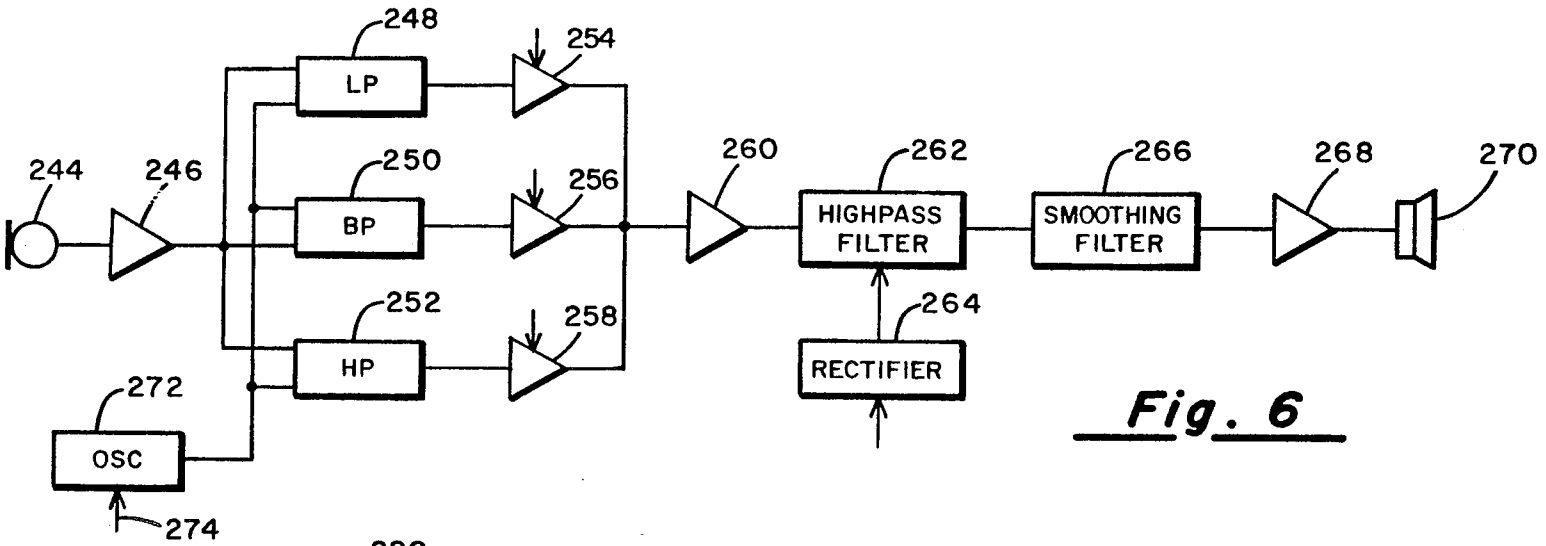
FIG. 6 is a diagrammatic representation of analog circuitry as an alternative embodiment to that illustrated in FIG. 2.

FIG. 6 illustrates an alternative to the analog circuitry in FIG. 2, in which the summing amplifier output is provided to the adaptive high-pass filter. More particularly, the output of a microphone 244 is provided to a pre-amplifier 246, with the pre-amplifier output provided to a low-pass filter 248, a bandpass filter 250 and a high-pass filter 252, these filters being essentially similar in function to previously discussed filters 56–60. Restricted bandwidth filters 248, 250 and 252 provide their output, respectively, to operational transconductance amplifiers 254, 256 and 258. Each of amplifiers 254–258 has an input for controlling the gain (i.e. attenuation) between its respective filter and a summing amplifier 260, in the same manner in which the gain of amplifier 200, for example, is controlled. The combined signal output of amplifier 260 is provided to a voltage controlled adaptive high-pass pass filter 262 receiving a control signal from a rectifier 264.

The adaptive filter provides its output to a smoothing filter 266, to a power amplifier 268 and then to a receiver 270. An oscillator 272, similar to oscillator 46, provides a clocking signal to each of filters 248–252. A control input 274 determines the clocking frequency, thus to set the control frequencies of the respective filters 248–252. An input 275 is provided to rectifier 264 for varying the control signal provided to filter 262. Preferably input 275 is the output of preamplifier 246. As an alternative, this input can be the output of summing amplifier 260.

Figure 7:
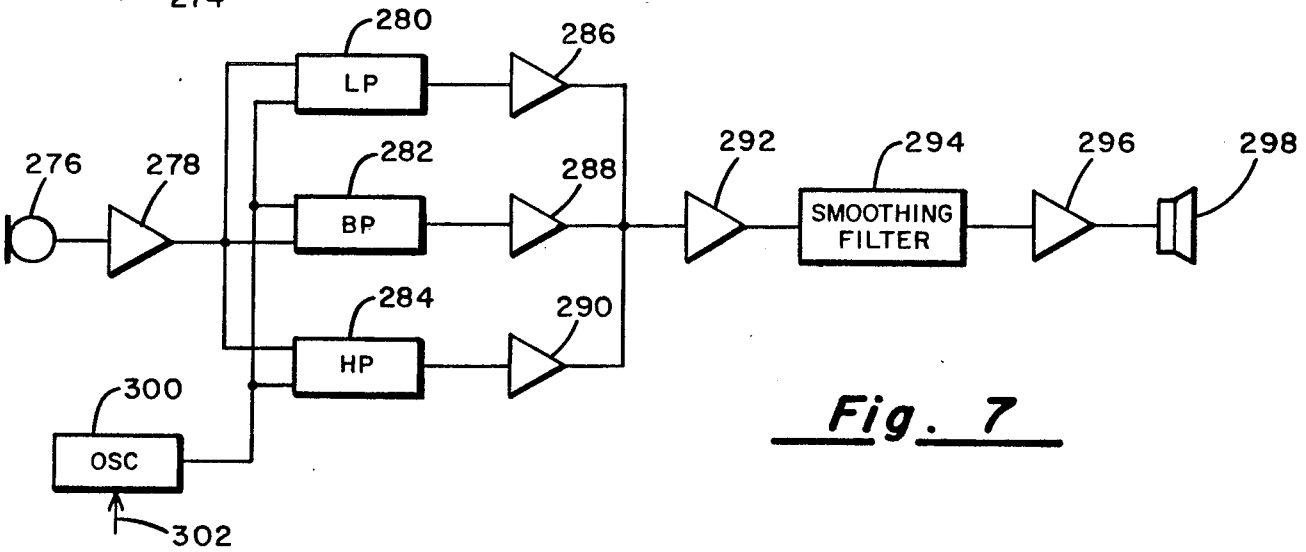
FIG. 7 is a diagrammatic illustration of analog circuitry as another alternative embodiment to the circuitry illustrated in FIG. 2.

FIG. 7 shows a simplified alternative analog circuit which dispenses with adaptive high-pass filtering. A microphone 276 provides its output to a pre-amplifier 278, the output of which is provided to a low-pass filter 280, a bandpass filter 282 and a high-pass filter 284. Each of these restricted bandwidth filters provides its output to a respective one of operational amplifiers 286, 288 and 290. The output of amplifier 286–290 is provided to a summing amplifier 292, which provides its output to a smoothing filter 294, then to a power amplifier 296 and finally to a receiver 298.

An oscillator 300 provides a clocking signal to each of filters 280–284, with the clocking frequency being determined in accordance with a control input 302 from a programmably controlled current sink similar to current sink 196. Amplifiers 286–290 are individually controlled through corresponding pairs of RAm registers and digital-to-analog converters, as discussed in connection with FIG. 3.

Thus, in accordance with the present invention a hearing aid is programmed with DTMF signals to the hearing aid microphone, completely eliminating the need for expensive external programming equipment and connector structure embedded into or mounted on the hearing aid shell. Programming can be completed at any stage of manufacture of the hearing aid, and may be repeated numerous times after assembly of the aid. A hand-held DTMF program generator may provide signals directly to the hearing aid microphone, or alternatively remote programming can occur over telephone lines, while the client is wearing the aid. A muting signal ensures that such reprogramming is accomplished without discomfort to the user. Finally, the combination of permanent memory and volatile, battery backed memory allows temporary storage of programmed instructions for trial, subject to reprogramming prior to permanent storage.

What is claimed is:

1. A signal processing circuit for a hearing aid, including:

a sound pressure level transducing means for sensing an audio signal and generating an electrical signal corresponding to said sensed audio signal, and a broadband signal amplifying means for amplifying said electrical signal to produce an amplified electrical signal;

a broadband detecting means for receiving a control input and for generating a control signal having a control signal level proportional to the level of said control input;

an adaptive high-pass filtering means, having as a first input said amplified electrical signal, and as a second input said control signal, for selectively suppressing a low frequency portion of said amplified electrical signal to generate a selectively modified signal, the frequency bandwidth of said suppressed low frequency portion, relative to the width of the entire frequency spectrum of said amplified electrical signal, increasing with said control signal level;

a plurality of restricted bandwidth filters, each receiving said modified signal and enhancing a selected portion of the frequency bandwidth of said modified signal to generate a selected bandwidth signal as its output, and a summing means for receiving said selected bandwidth signals as inputs, and for generating a combined signal based on the summation of said selected bandwidth signals;

an oscillator means for generating a clocking signal provided to each of said restricted bandwidth filters to determine a control frequency for each restricted bandwidth filter, and means for adjustably controlling said oscillator means to simultaneously adjust said control frequencies; and a receiver means for generating an audio signal corresponding to said combined signal.

2. The signal processing circuit of claim 1 wherein:

said control input comprises said amplified electrical signal.

3. The signal processing circuit of claim 1 wherein:

said control input comprises said combined signal.

4. The signal processing circuit of claim 1 further including:

an anti-aliasing filter receiving said modified signal and providing its output to each of said restricted bandwidth filters.

5. The signal processing circuit of claim 4 further including:

sample and hold circuitry receiving the output of said anti-aliasing means, and providing its output as an input to each of said selective bandwidth filters.

6. The signal processing circuit of claim 5 wherein:

said means for adjustably controlling said oscillator means includes a clocking control means including a data storage means for storing one of a plurality of oscillator control settings for input to said oscillator means, and a control setting input means, operatively associated with said sound pressure level transducing means and said clocking control means, for providing a predetermined programming signal to said clocking control means responsive to the sensing of a predetermined audio signal by said sound pressure level transducing means, wherein said clocking control means, responsive to receiving said programming signal, selectively alters the oscillator control setting stored in said data storage means.

7. The signal processing circuitry of claim 1 further including:

a plurality of attenuator means, one associated with each of said restricted bandwidth filters, each for receiving its associated one of said selected bandwidth signals and controllably attenuating said signal to provide an attenuated bandwidth signal to said summing amplifier, whereby said combined signal is based on said attenuated signals.

8. The signal processing circuit of claim 7 further including:

a plurality of attenuator control means, one associated with each of said attenuator means, for adjustably determining the degree of attenuation of its associated attenuator means.

9. The signal processing circuit of claim 8 wherein:

each of said attenuator control means includes a data storage means for storing one of a plurality of attenuator control settings, and an attenuator control setting input means operatively associated with said sound pressure level transducing means, for providing a predetermined programming signal to said attenuator control means responsive to the sensing of a predetermined audio signal by said sound pressure level sensing means, wherein said attenuator control means, responsive to receiving said programming signal, selectively alters the attenuator control setting stored in said data storage means.

10. The signal processing circuit of claim 1 wherein:

said means for adjustably controlling said oscillator means comprises a clocking control means including a data storage means for storing one of a plurality of oscillator control settings for input to said oscillator means, and a control setting input means for providing a predetermined programming signal to said clocking control means, wherein said clocking control means, responsive to receiving said programming signal, selectively alters the oscillator control setting stored in said data storage means.

11. The signal processing circuit of claim 10 wherein:

said control setting input means is operatively associated with said sound pressure level transducing means and said clocking control means, and provides the predetermined programming signal to said clocking control means responsive to the sensing of a predetermined audio signal by said sound pressure level transducing means.

12. The signal processing circuit of claim 10 wherein:

said data storage means includes a nonvolatile, programmable digital memory for storing said control settings.

13. The signal processing circuit of claim 12 wherein:

said control settings include a plurality of current settings respectively relating to filter center frequencies, a peak clipping amplitude, a filter sensitivity, and a tone control of a variable cut-off frequency for an adaptive high-pass filter.

14. A signal processing circuit for a hearing aid, including:

a sound pressure level transducing means for sensing an audio signal and generating an electrical signal corresponding to said sensed audio signal, and a broadband signal amplifying means for amplifying said electrical signal to produce an amplified electrical signal;

a plurality of restricted bandwidth filters, each receiving said amplified electrical signal and enhancing a selected portion of the frequency bandwidth of said amplified electrical signal to generate a selected bandwidth signal as its output, and a summing means for receiving said selected bandwidth signals as inputs, and for generating a combined signal based on the summation of said selected bandwidth signals;

an oscillator means for generating a clocking signal, said clocking signal being provided to each of said restricted bandwidth filters to determine a control frequency for each restricted bandwidth filter, and means for adjustably controlling said oscillator means to simultaneously adjust said control frequencies;

a broadband detecting means for receiving a control input and for generating a control signal having a control signal level proportional to the level of said control input;

an adaptive high-pass filtering means, having as a first input said combined signal and as a second input said control signal, for selectively suppressing a low frequency portion of said combined signal to generate a selectively modified signal, the frequency bandwidth of said suppressed low frequency portion, relative to the width of the entire frequency spectrum of said combined electrical signal, increasing with said control signal level; and a receiver means for generating an audio signal corresponding to said modified electrical signal.

15. The signal processing circuit of claim 14 wherein:

said control input comprises said amplified electrical signal.

16. The signal processing circuit of claim 14 wherein:

said control input comprises said combined signal.

17. The signal processing circuit of claim 14 wherein:

said restricted bandwidth filters include a low-pass filter, a high-pass filter and a bandpass filter, and wherein said control frequencies include a cut-off frequency for said high-pass filter, a cut-off frequency for said low-pass filter, and a center frequency for said bandpass filter.

18. The signal processing circuit of claim 14 wherein:

said means for adjustably controlling said oscillator means comprises a clocking control means including a data storage means for storing one of a plurality of oscillator control settings for input to said oscillator means, and a control setting input means for providing a predetermined programming signal to said clocking control means; and wherein said clocking control means, responsive to receiving said programming signal, selectively alters the oscillator control setting stored in said data storage means.

19. The signal processing circuit of claim 18 wherein:

said control setting input means is operatively associated with said sound pressure level transducing means and said clocking control means, and provides the predetermined programming signal to said clocking control means responsive to the sensing of a predetermined audio signal by said sound pressure level transducing means.

20. The signal processing circuit of claim 18 wherein: said data storage means includes a nonvolatile, programmable digital memory for storing said control settings.

21. The signal processing circuit of claim 20 wherein: said control settings include a plurality of current settings respectively relating to filter center frequencies, a peak clipping amplitude, a filter sensitivity, and a tone control of a variable cut-off frequency for an adaptive high-pass filter.

* * * * *